US005192426A

United States Patent [19]

DeCoster et al.

[11] Patent Number: 5,192,426

[45] Date of Patent: Mar. 9, 1993

[54] WATER RECLAMATION SYSTEM FOR LANDSCAPE IRRIGATION

[76] Inventors: Marc DeCoster, 759 Tawney Ct., Oceanside, Calif. 92056; Jay L. Hoffman, 751 Tawney Ct., Oceanside, Calif. 92057

[21] Appl. No.: 701,489

[22] Filed: May 16, 1991

[51] Int. Cl.[5] ..... E02B 13/02

[52] U.S. Cl. ..... 210/117; 210/170; 405/36

[58] Field of Search ..... 210/167, 170, 117, 919, 210/136; 405/36, 43, 51

[56] References Cited

U.S. PATENT DOCUMENTS

| | | | |
|---|---|---|---|
| 3,318,449 | 5/1967 | Jennings et al. | 210/104 |
| 3,543,294 | 11/1970 | Boester | 210/170 |
| 3,797,667 | 3/1974 | Rod | 210/304 |
| 4,017,395 | 4/1977 | Davis | 210/167 |
| 4,162,218 | 7/1979 | McCormick | 210/167 |
| 4,191,647 | 3/1980 | Mullerheim et al. | 210/170 |
| 4,228,006 | 10/1980 | Hanna | 210/170 |
| 4,359,789 | 11/1982 | Roberts | 210/167 |
| 4,588,325 | 5/1986 | Seefert | 405/46 |
| 4,871,452 | 10/1989 | Kohler et al. | 210/167 |

*Primary Examiner*—Peter Hruskoci
*Assistant Examiner*—Robert James Popovics
*Attorney, Agent, or Firm*—Stetina and Brunda

[57] ABSTRACT

This invention relates to a water reclamation system for reclaiming grey water and ground water from sources associated with a domestic dwelling and subsequently utilizing such water in conjunction with a landscape irrigation system. The system generally comprises a storage reservoir which is fluidly connected to a main irrigation line comprising the landscape irrigation system. The reservoir includes a number of inlet conduits connected thereto which are in fluid communication with grey water sources from within the dwelling and with yard drains which receive ground water. The reservoir also includes an overflow line interfaced thereto which is adapted to drain excess water from within the reservoir to a main sewage line. The water provided to the irrigation system via the storage reservoir is supplied only as an alternative to water which may be supplied thereto via a main water line.

7 Claims, 1 Drawing Sheet

WATER RECLAMATION SYSTEM FOR LANDSCAPE IRRIGATION

FIELD OF THE INVENTION

The present invention relates generally to water recovery systems, and more particularly to a recovery system which reclaims ground water run-off and "grey" water from sources associated with a domestic dwelling, and recycles such water for use in conjunction with a landscape irrigation system.

BACKGROUND OF THE INVENTION

In typical domestic households, vast quantities of water are often consumed on a daily basis. However, only a fraction of the water consumed is utilized for food or cooking. In this respect, most of the water is employed for laundry purposes, washing, baths or showers, and in the disposal of human waste. Additionally, large quantities of water are also utilized for other domestic tasks, such as landscape watering, and washing cars. The term "grey water" is often used to define the major portion of water utilized in human activities which is typically drained into sewer systems after use. Particularly, grey water generally includes all of the waste water currently handled by sewer systems excepting only waste water from toilets. The most common sources of grey water associated with domestic dwellings include sinks, tubs, showers and washing machines. Additionally, the term "ground water" generally includes all water utilized for landscape irrigation and/or rain water which falls upon the landscape and typically runs off the same and into the storm drain and/or sewer system.

As can be appreciated, in most households, and particularly in large households, large quantities of grey water are disposed into the sewer system on a daily basis. As is well known, various regions of the United States have been affected by drought conditions over recent years, which has led to the implementation of mandatory water rationing and various types of water use restrictions in these areas for purposes of conserving limited water resources. One of the most common types of restrictions currently imposed are sprinkling bans on lawn watering and irrigation. As will be recognized, such sprinkling bans impose significant hardships on many homeowners with respect to the maintenance and upkeep of the lawn and landscaped areas of the property.

Though various prior art systems have been developed to reclaim the grey water typically disposed into the sewer system, such systems have not been developed specifically for use in conjunction with landscape irrigation systems and do not include the capacity to reclaim ground water. Since lawn sprinkling bans are common in areas of the country affected by drought, the potential advantages attendant to the use of reclaimed grey water and ground water for purposes of landscape irrigation become significant. Importantly, many prior art grey water reclamation systems are not well suited for purposes of providing recycled grey water for domestic usage due to the inability of the filters associated with these systems to sufficiently remove contaminants, such as detergents, from the grey water. In recent years however, advancements in filter technology have made more practical the potential for limited domestic use of reclaimed grey water. Though currently known filters are not suitable for processing grey water for use in food, cooking, washing, or bathing, such filters remove sufficient amounts of contaminants so as to make the reclaimed water usable for purposes of landscape irrigation without the risk of causing derogatory environmental effects. The present invention recognizes this potential use of reclaimed grey water by providing a water reclamation system which reclaims grey water and ground water for use with a landscape irrigation system.

SUMMARY OF THE INVENTION

In accordance with the preferred embodiment of the present invention, there is provided a water reclamation system which reclaims grey water and ground water for use with lawn irrigation/sprinkler systems. The system comprises a storage reservoir which is located adjacent to a domestic dwelling or residence. The reservoir includes a pump thereon which is used to pump water from within the reservoir to a first outlet conduit. The first outlet conduit of the reservoir/pump extends to a conventional filter and subsequently ties into a main irrigation line of the residential irrigation/sprinkler system. The main irrigation line is additionally in flow communication with a main water line via a conventional gate valve, water meter, and back-flow preventer or check valve. Preferably, the drain plumbing within the dwelling is modified or alternatively, specifically designed at the time of construction of the dwelling, to include grey water drain sources from the bath water, drain water, and washing machine water which are supplied to the reservoir. Additionally, a plurality of conventional yard drains are provided to extend about the perimeter of the dwelling to collect any ground water and to input the same into the reservoir for storage. The reservoir further includes an over-flow drain line which extends via a back-flow preventer or check valve to a main sewer line.

In operation, initial yard watering is accomplished via the flow of water from the water main through the gate valve, water meter, back-flow preventer, and into the main irrigation line for delivery to the yard, landscape, and plants. In this operational mode, a check valve adjacent the reservoir is maintained in a closed position to ensure that water from the water main does not travel through the first outlet conduit into the reservoir. Any ground water is accumulated via the yard drains and inputted into the reservoir for storage. Additionally, throughout normal residence operation, grey water from the bath water, drain water, and washing machine water is preferably inputted into and stored within the reservoir. After a sufficient amount of water has been accumulated in the reservoir, subsequent irrigation operations are facilitated by closing the gate valve, and activating the pump upon the reservoir. In this operational mode, water from within the reservoir travels through the filter to remove any substantial debris therefrom and subsequently into the main irrigation line for deposition upon the landscape. In those instances, such as heavy rain situations, where water inputted into the reservoir from the yard drains exceeds the capacity of the reservoir, the over-flow drain line is operative to communicate such excess water to the main sewer line. Additionally, the back-flow preventer within the over-flow line is operative to prevent any back-flow from the sewer line to the reservoir via the over-flow line.

BRIEF DESCRIPTION OF THE DRAWINGS

These as well as other features of the present invention will become apparent upon reference to the drawing wherein.

DETAILED DESCRIPTION OF THE PREFERRED EMBODIMENT

Figure 1:
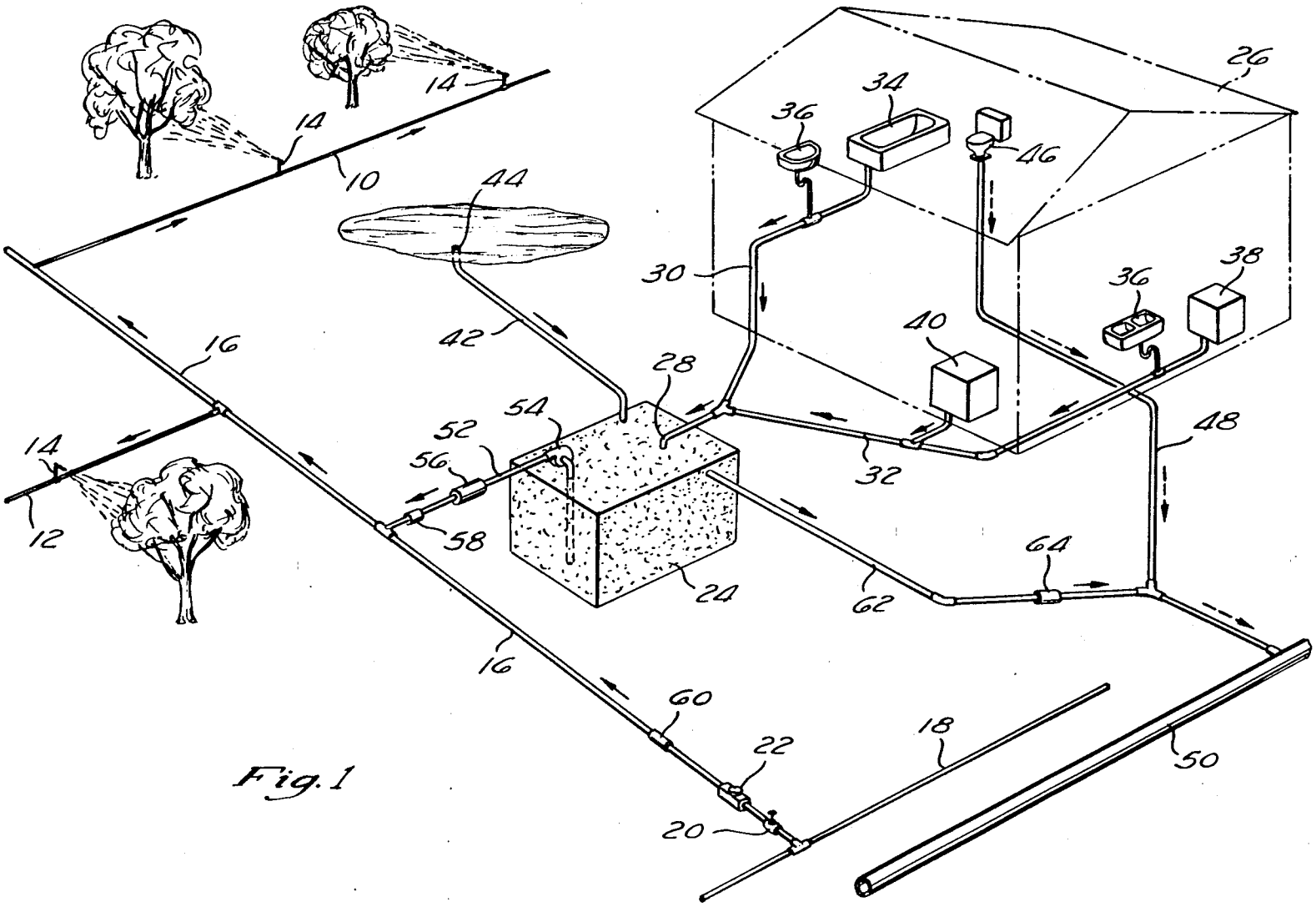
FIG. 1 is a perspective view of a piping diagram, illustrating the components comprising and the preferred manner of implementing the water reclamation system of the present invention.

Referring now to the drawing wherein the showing is for purposes of illustrating a preferred embodiment of the present invention only, and not for purposes of limiting the same, FIG. 1 perspectively illustrates the water reclamation system constructed in accordance with the preferred embodiment of the present invention. As seen in FIG. 1, the reclamation system of the present invention is preferably used in conjunction with a landscape irrigation system comprising irrigation conduits 10 and 12, having sprinkler heads 14 interfaced thereto. As will be recognized, sprinkler heads 14 are used to spray water from the irrigation system onto the lawn and trees of the yard of a domestic dwelling 26.

The irrigation conduits 10 and 12 are in fluid communication with a main irrigation line 16 of the irrigation system. Main irrigation line 16 is in turn fluidly connected to a water main 18. Disposed within main irrigation line 16 at a location immediately adjacent water main 18 is a gate valve 20. In the preferred embodiment, gate valve 20 is used to selectively place main irrigation line 16 into fluid communication with water main 18 thereby allowing water from water main 18 to pass through irrigation conduits 10 and 12 for dispersion onto the yard via sprinkler heads 14. Additionally, disposed within irrigation line 16 between gate valve 20 and the irrigation conduits 10 and 12 is a water meter 22. When gate valve is actuated so as to allow water to pass from water main 18 into irrigation line 16, water meter 22 is operable to provide an indication of the volume of water being utilized by the irrigation system.

Referring now to the various components comprising the reclamation system of the present invention, a storage reservoir 24 is provided which is located adjacent the domestic dwelling 26. The reservoir 24 is preferably disposed under ground, similar to a septic tank, though it will be appreciated that such reservoir 24 may be located above ground. Connected to reservoir 24 is a first reservoir inlet conduit 28 which is used for inputting grey water from sources within dwelling 26 into the reservoir 24. Particularly, inlet conduit 28 is interfaced via lines 30 and 32 to the drains of household devices such as bathtub 34, sinks 36, dishwasher 38, and clothes washer 40. Also connected to reservoir 24 is a second reservoir inlet conduit 42 which is used to input ground water into the reservoir 24. In the preferred embodiment, the inputting of ground water into the reservoir 24 is facilitated by one or more yard drains 44 disposed within the lawn and connected to the second inlet conduit 42. As such, reservoir 24 is adapted to receive grey water and ground water from all such sources associated with the dwelling 26. Thus, the only water-using or containing device of dwelling 26 typically not interfaced to reservoir 24 is the toilet 46 which, for sanitary reasons, is directly interfaced via a line 48 to a main sewage line 50.

To facilitate the use of the water stored within reservoir 24 for purposes of landscape irrigation, connected to reservoir 24 is a first outlet conduit 52. In the preferred embodiment, first outlet conduit 52 is connected to main irrigation line 16 so as to place reservoir 24 in fluid communication therewith. Connected within first outlet conduit 52 and positioned upon reservoir 24 is a pump 54. As can be appreciated, pump 54 is used to pump water from within reservoir 24 through first outlet conduit 52 and into irrigation line 16 for subsequent output through irrigation conduits 10 and 12 and sprinkler heads 14 onto the landscape. Importantly, pump 54 is only activated when gate valve 20 is closed, i.e. preventing water from entering irrigation line 16 from water main 18. Thus, the water from within reservoir 24 is intended to be used for landscape irrigation only as an alternative to, and not in conjunction with, water from water main 18.

Positioned within first outlet conduit 52 between pump 54 and irrigation line 16 is a filter 56. In the preferred embodiment, filter 56 is adapted to filter substantial debris and contaminants, such as detergents, from the water within storage reservoir 24 before such is inputted into irrigation line 16. Also positioned within first outlet conduit 52 between filter 56 and irrigation line 16 is a heck valve 58. When gate valve 20 is opened, i.e. allowing water to flow from water main 18 into irrigation line 16, check valve 58 is operative to prevent water from flowing from the main irrigation line 16 into the reservoir 24 via the first outlet conduit 52. As such, water will travel directly from the water main 18 through the irrigation line 16 and into the irrigation conduits 10 and 12. Additionally, a first back-flow preventer 60 is positioned within irrigation line 16 between water meter 22 and first outlet conduit 52. When gate valve 20 is in the off position and pump 54 is activated to pump water from within reservoir 24 into irrigation line 16, first backflow preventer 60 prevents such water from flowing from irrigation line 16 into the water main 18.

Also connected to storage reservoir 24 is a second outlet conduit 62. In the preferred embodiment, second outlet conduit 62 is used as an over-flow drain line for the reservoir 24. Particularly, when reservoir 24 exceeds its maximum water holding capacity, such excess water is drained via second outlet conduit 62 into the main sewage line 50. As illustrated in FIG. 1, second outlet conduit 62 is interfaced to line 48 extending from toilet 46 before entering main sewage line 50. Positioned within second outlet conduit 62 is a second back-flow preventer 64. In the preferred embodiment, second back-flow preventer 64 is used to prevent back-flow from the main sewage line 50 into the reservoir 24 via the second outlet conduit 62.

Having thus described the components of the water reclamation system and landscape irrigation system of the present invention, the combined operation of such systems will now be explained. To facilitate the initial watering of the lawn of the dwelling 26, the gate valve 20 is opened which thus allows water to flow from the water main 18 into the irrigation line 16. Importantly, when gate valve 20 is opened, pump 54 is not active, thereby preventing any water from within reservoir 24 from being inputted into irrigation line 16 simultaneously with water from water main 18. Water from water main 18 flows through irrigation line 16 and subsequently into irrigation conduits 10 and 12 for eventual application onto the trees and lawn via the sprinkler heads 14. Ground water is caught by yard drains 44 and inputted via second outlet conduit 42 into the storage reservoir 24. Additionally, grey water from various sources within the dwelling 26 is inputted via the first inlet conduit 28 into the storage reservoir 24.

When storage reservoir 24 contains sufficient quantities of water to conduct a lawn watering operation, gate valve 20 is maintained in a closed position and pump 54 is activated, thereby drawing water from within reservoir 24 and inputting such water into first outlet conduit 52. Water passing through first outlet conduit 52 passes through filter 56, check valve 58, and into irrigation line 16 for subsequent dispersion onto the landscape. Water is prevented from flowing from reservoir 24 into water main 18 by first back-flow preventer 60.

When the water inputted into storage reservoir 24 from the sources within the dwelling 26 or yard drains 44 exceeds the capacity of reservoir 24, such water is drained from reservoir 24 into the main sewage line 50 via second outlet conduit 62. The second back-flow preventer 64 positioned within the second outlet conduit 62 prevents any back-flow from the sewage line 50 from entering the storage reservoir 24. Thus, the present system provides an efficient means of recycling grey water and ground water from various sources associated with the dwelling 26 for landscape irrigation purposes.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. A water reclamation system for use with a landscape irrigation system, comprising:

a storage reservoir located adjacent a domestic dwelling;

a first reservoir inlet conduit for inputing gray water from sources within said dwelling into said reservoir;

a second reservoir inlet conduit for inputing gray water from sources outside of said dwelling into said reservoir;

at least one drain disposed within a lawn of said dwelling and connected to said second inlet conduit for inputing ground water into said reservoir;

a first reservoir outlet conduit for placing said reservoir in fluid communication with said landscape irrigation system;

a second reservoir outlet conduit for providing an overflow drain line from said reservoir to a sewage line;

a pump positioned within said first outlet conduit for pumping water from within said reservoir into said irrigation system; and a filter positioned within said first outlet conduit for filtering water pumped from said reservoir before the water is inputed into said irrigation system.

2. The system of claim 1 further comprising a main irrigation line for placing said irrigation system in fluid communication with a water main, said first outlet conduit connecting said reservoir to said irrigation line.

3. The system of claim 2 further comprising a check valve positioned in said first outlet conduit between said filter and said irrigation line for preventing the flow of water from said water main into said reservoir.

4. The system of claim 3 further comprising a gate valve positioned within said irrigation line between said water main and said first outlet conduit for selectively placing said irrigation line in fluid communication with said water main.

5. The system of claim 4 further comprising a water meter positioned within said irrigation line between said gate valve and said first outlet conduit.

6. The system of claim 5 further comprising a first back-flow preventer positioned within said irrigation line between said water meter and said first outlet conduit for preventing the back-flow of grey water from said reservoir into said water main.

7. The system of claim 1 further comprising a second back-flow preventer positioned within said second outlet conduit for preventing back-flow from said sewage line into said reservoir via said second outlet conduit.

* * * * *